US007459858B2

(12) United States Patent
Hruby et al.

(10) Patent No.: US 7,459,858 B2
(45) Date of Patent: Dec. 2, 2008

(54) HALL THRUSTER WITH SHARED MAGNETIC STRUCTURE

(75) Inventors: Vladimir J. Hruby, Newton, MA (US); Bruce Pote, Sturbridge, MA (US); Rachel A. Tedrake, Natick, MA (US); Lawrence T. Byrne, Cranston, RI (US); James J. Szabo, Jr., Bedford, MA (US); Juraj Kolencik, Newton, MA (US)

(73) Assignee: Busek Company, Inc., Natick, MA (US)

( * ) Notice: Subject to any disclaimer, the term of this patent is extended or adjusted under 35 U.S.C. 154(b) by 420 days.

(21) Appl. No.: 11/301,857

(22) Filed: Dec. 13, 2005

(65) Prior Publication Data

US 2006/0186837 A1 Aug. 24, 2006

Related U.S. Application Data

(60) Provisional application No. 60/635,639, filed on Dec. 13, 2004.

(51) Int. Cl.
*H05B 7/24* (2006.01)
*H01J 27/00* (2006.01)
*G21G 4/00* (2006.01)

(52) U.S. Cl. ..... 315/111.21; 315/111.41; 315/111.61; 315/111.81; 250/423 R; 250/427; 250/493.1

(58) Field of Classification Search ..... 315/111.21, 315/111.41, 111.61, 111.81; 250/423 R, 250/427, 493.1
See application file for complete search history.

(56) References Cited

U.S. PATENT DOCUMENTS

| | | | | |
|---|---|---|---|---|
| 6,075,321 | A | 6/2000 | Hruby et al. | |
| 6,150,764 | A | 11/2000 | Hruby et al. | |
| 6,208,080 | B1 * | 3/2001 | King et al. | 315/111.41 |
| 6,215,124 | B1 * | 4/2001 | King | 250/423 R |
| 6,279,314 | B1 * | 8/2001 | Valentian et al. | 60/202 |
| 6,612,105 | B1 * | 9/2003 | Voigt et al. | 60/202 |
| 6,735,935 | B2 | 5/2004 | Hruby et al. | |
| 6,834,492 | B2 * | 12/2004 | Hruby et al. | 60/202 |
| 7,030,576 | B2 | 4/2006 | McVey et al. | |
| 7,116,054 | B2 * | 10/2006 | Zhurin | 315/111.41 |
| 7,164,227 | B2 * | 1/2007 | de Grys | 313/361.1 |
| 2002/0116915 | A1 * | 8/2002 | Hruby et al. | 60/202 |

* cited by examiner

*Primary Examiner*—Douglas W. Owens
*Assistant Examiner*—Jianzi Chen
(74) *Attorney, Agent, or Firm*—Iandiorio Teska & Coleman

(57) ABSTRACT

A Hall thruster with a shared magnetic structure including a plurality of plasma accelerators each including an anode and a discharge zone for providing plasma discharge. An electrical circuit having one or more cathodes connected to the plurality of plasma accelerators emits electrons that are attracted to the anode in each of the plasma accelerators. A shared magnetic circuit structure establishes a transverse magnetic field in each of the plurality of plasma accelerators that creates an impedance to the flow of electrons toward the anode in each of the plurality of plasma accelerators and enables ionization of a gas moving through one or more of the plurality of plasma accelerators. The impedance localizes an axial electric field in the plurality of plasma accelerators for accelerating ionized gas through the one or more of the plurality of plasma accelerators to create thrust.

29 Claims, 16 Drawing Sheets

HALL THRUSTER WITH SHARED MAGNETIC STRUCTURE

RELATED APPLICATIONS

This application claims benefit of U.S. Provisional Application Ser. No. 60/635,639 filed Dec. 13, 2004, incorporated by reference herein.

GOVERNMENT RIGHTS

This invention was made with U.S. Government support under Contract No. F04611-03-M-3014 awarded by the Office of the Secretary of Defense (OSD). The Government may have certain rights in the subject invention.

FIELD OF THE INVENTION

This invention relates generally to a Hall thrusters and more particularly to an improved Hall thruster with a shared magnetic structure.

BACKGROUND OF THE INVENTION

Hall Thrusters are typically used in rockets, satellites, spacecraft, and the like. In a typical Hall Thruster the working fluid is plasma and the means of acceleration is an electric field. A Hall thruster typically includes a plasma accelerator that includes a propellant, a gas distributor, and an anode located at one end of a channel. An electric circuit provides an electric potential that is applied between the anode and a floating externally located cathode that emits electrons. A magnetic circuit structure typically includes an outer pole, an inner pole, and a plurality of outer magnetic field sources, e.g., electromagnetic coils or permanent magnets, for the outer pole and an inner magnetic field source for the inner pole. The magnetic circuit structure establishes a transverse magnetic field between the outer pole and the inner pole that presents an impedance to electrons attracted to the anode. As a result, the electrons spend most of their time drifting azimuthally (orthogonally) due to the transverse magnetic field. This allows the electrons time to collide with and ionize the neutral atoms. The collisions create positively charged ions that are accelerated by the electric field to create thrust. See e.g., U.S. Pat. Nos. 6,150,764; 6,078,321; 6,834,492 by one or more common inventors hereof, all incorporated in their entity by reference herein.

When a plurality of conventional Hall thrusters are arranged in close proximity to each other to power a spacecraft or similar vehicle, each plasma accelerator of each thruster requires its own magnetic circuit structure that typically includes a plurality of outer magnetic field sources for the outer pole and an inner magnetic field source for the inner pole. Each thruster also includes its own power processing unit (PPU) that provides power for the magnetic circuit structure and the electric circuit. Such a design suffers from excessive weight, volume and power, is complex, expensive, and inefficient.

BRIEF SUMMARY OF THE INVENTION

It is therefore an object of this invention to provide an improved Hall thruster with a shared magnetic structure.

It is a further object of this invention to provide such a Hall thruster which can share one or more magnetic circuit structures with a plurality of plasma accelerators.

It is a further object of this invention to provide such a Hall thruster which reduces the number of magnetic field sources needed for a plurality of plasma accelerators.

It is a further object of this invention to provide such a Hall thruster which reduces the weight.

It is a further object of this invention to provide such a Hall thruster which can share a single power processing unit with a plurality of plasma accelerators.

It is a further object of this invention to provide such a Hall thruster which reduces the volume.

It is a further object of this invention to provide such a Hall thruster which saves power.

It is a further object of this invention to provide such a Hall thruster which provides for steering of the Hall thruster.

It is a further object of this invention to provide such a provides for attitude control of the Hall thruster.

It is a further object of this invention to provide such a Hall thruster which provides for throttle adjustment of the Hall thruster.

It is a further object of this invention to provide such a Hall thruster is less complex.

It is a further object of this invention to provide such a Hall thruster which is less expensive.

It is a further object of this invention to provide such a Hall thruster which is more efficient.

The invention results from the realization that an improved Hall thruster that can share one or more magnetic circuit structures with a plurality of plasmas accelerators to reduce the weight, volume, and power requirements of the Hall thruster and also provide for steering, attitude control and throttle adjustment is effected with a plurality of plasma accelerators that each include an anode and a discharge chamber to provide plasma discharge, an electrical circuit that includes at least one cathode connected to the plurality of plasma accelerators that emit electrons that are attracted to the anode in each of the plasma accelerators, and a shared magnetic circuit structure that establishes a transverse magnetic field in each of the plasma accelerators which presents an impedance to the flow of electrons towards the anode in each of the plurality of plasma accelerators and enables ionization of a gas moving through one or more of the plurality of plasma accelerators and which creates an axial electric field in each of the plurality of plasma accelerators for accelerating ionized gas through one or more of the plurality of accelerators to create thrust.

The subject invention, however, in other embodiments, need not achieve all these objectives and the claims hereof should not be limited to structures or methods capable of achieving these objectives.

This invention features a Hall thruster with a shared magnetic structure including a plurality of plasma accelerators each including an anode and a discharge zone for plasma discharge occurs in the presence of imposed electric and magnetic field. An electrical circuit having one or more cathodes connected to the plurality of plasma accelerators that emit electrons that are attracted to the anode in each of the plasma accelerators. A shared magnetic circuit structure establishes a transverse magnetic field in each of the plurality of plasma accelerators that creates an impedance to the flow of electrons toward the anode in each of the plurality of plasma accelerators and enables ionization of a gas moving through one or more of the plurality of plasma accelerators. The impedance localizes an axial electric field in the plurality of plasma accelerators for accelerating ionized gas through the one or more of the plurality of plasma accelerators to create thrust.

In one embodiment, the shared magnetic circuit structure may include at least one magnetic field source for creating the transverse magnetic field in each of the plurality of plasma accelerators. The at least one magnetic field source may include a magnetic field source chosen from the group consisting of an electromagnetic coil and a permanent magnet. The shared magnetic circuit structure may include a selected combination of the at least one magnetic field source. The shared magnetic circuit structure may include an outer pole and an inner pole for each of the plurality of plasma accelerators. The shared magnetic circuit structure may include a magnetic material interconnecting the outer pole and the inner pole. The shared magnetic circuit structure may include at least one shared magnetic path for establishing the transverse magnetic field in each of the plurality of plasma accelerators. The shared magnetic circuit structure may carry magnetic flux between the inner pole and the shared outer pole and through the magnetic material and the shared magnetic path. The shared magnetic path may include at least one magnetic field source chosen from the group consisting of an electromagnetic coil and a permanent magnet. The shared magnetic path may include a selected combination of the at least one magnetic field source. The Hall thruster may further include a plurality of shared magnetic paths for establishing the transverse magnetic field in each of the plurality of plasma accelerators. The plurality of shared magnetic cores each may include one or more magnetic field sources chosen from the group consisting of an electromagnetic coil and a permanent magnet. The plurality of magnetic paths may include a selected combination of the one or more magnetic field sources. The Hall thruster may further include a plurality of cathodes. The plurality of plasma accelerators may be selectively enabled for steering and attitude control of the Hall thruster. The shared magnetic path may reduce the number of the one or more magnetic sources required to achieve a predetermined transverse magnetic field in each of the plurality of plasma accelerators. The reduced number of the one or more magnetic field sources may decrease the weight and volume of the Hall thruster. The plurality of plasma accelerators may include one or more inner plasma accelerators and one or more outer plasma accelerators arranged concentrically. The shared magnetic path may provide an outer pole for the one or more inner plasma accelerators and an inner pole for the one or more outer plasma accelerators that establish the transverse magnetic field in each of the concentrically arranged plasma accelerators. The inner pole may be racetrack shaped. The inner pole and the outer pole may define a racetrack shaped plasma gap. The inner pole and the outer pole may be linearly shaped to define at least one linearly shaped plasma gap. The shared magnetic path may include a plurality of branches that provide the inner pole for each of the plurality of plasma accelerators. The plurality of branches may be arranged relative to each other in a configuration chosen from the group consisting of: an orthogonal configuration, an angle configuration, a parallel configuration, and an opposite configuration. The plurality of plasma accelerators may be arranged relative to each other in a configuration chosen from the group consisting of an orthogonal configuration, an angle configuration, a parallel configuration, and an opposite configuration. At least one of the plurality of plasma accelerators may be selectively enabled for steering and attitude control of the Hall thruster. The Hall thruster may further include one or more shared power processing units for providing power to the electrical circuit and the shared magnetic circuit structure. The gas may be selectively provided to at least one of the plurality of plasma accelerators to create the thrust. Selectively providing the gas to the one or more of the plurality of plasma accelerators may be used for throttling, steering, and attitude control of the Hall thruster.

This invention also features a Hall thruster with shared magnetic structure including a plurality of plasma accelerators that each provide a plasma discharge. A magnetic circuit structure including a shared magnetic core establishes a transverse magnetic field in each of the plurality of plasma accelerators to control the plasma discharge from each of the plurality of plasma accelerators. A plasma discharge circuit in each of the plurality of plasma accelerators creates a plasma and accelerating the plasma to produce thrust.

This invention also features a Hall thruster cluster with shared magnetic structure including a plurality of plasma accelerators that each provide a plasma discharge, a magnetic circuit structure including a shared outer pole and an inner pole for each of the plurality of plasma accelerators and a shared magnetic core for establishing a transverse magnetic field in each of the plurality of plasma accelerators to control the plasma discharge from each of the plurality of plasma accelerators, and a plasma discharge circuit in each of the plurality of plasma accelerators for creating a plasma and accelerating the plasma to produce thrust.

BRIEF DESCRIPTION OF THE DRAWINGS

Other objects, features and advantages will occur to those skilled in the art from the following description of a preferred embodiment and the accompanying drawings, in which.

Figure 1:
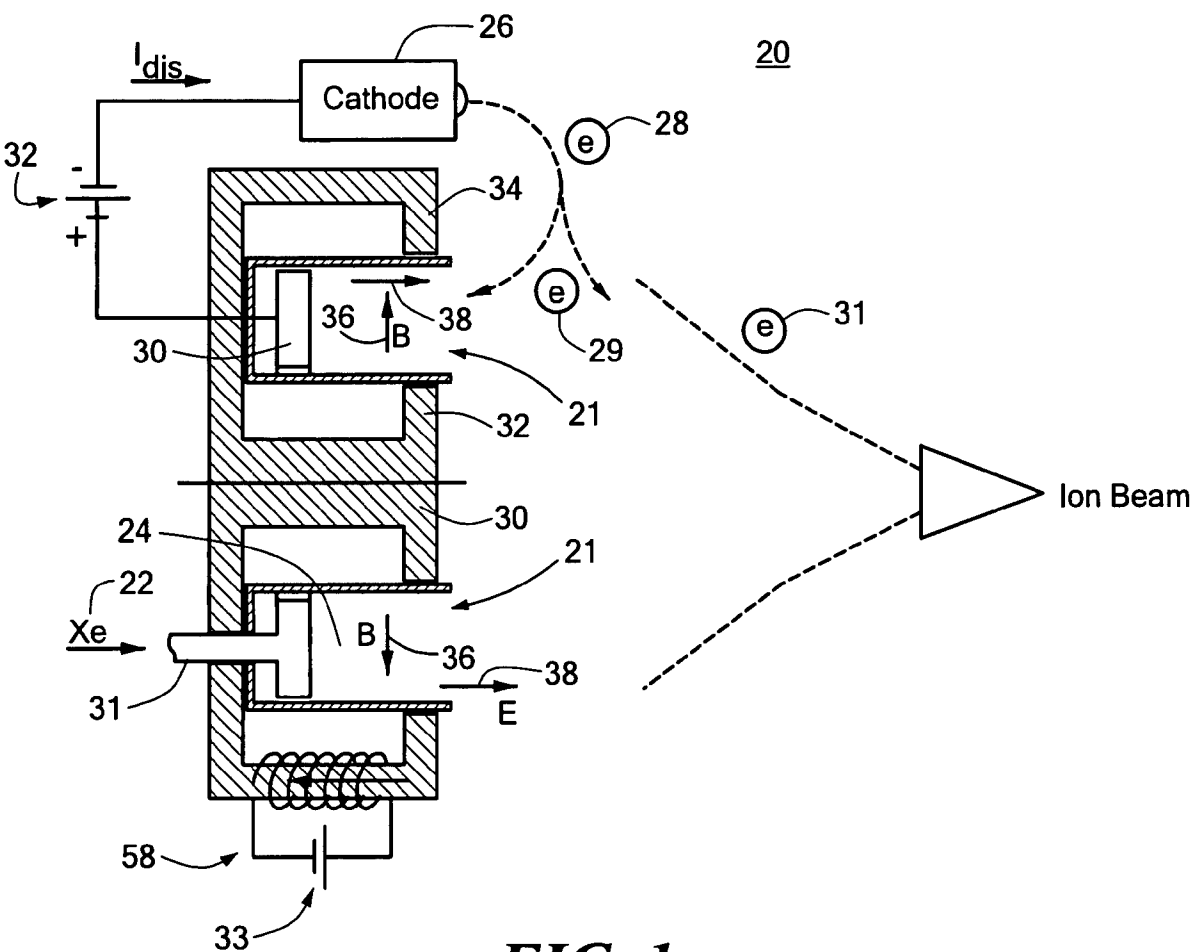
FIG. 1 PRIOR ART
FIG. 1 is a simplified, side sectional, schematic diagram of a typical prior art Hall thruster.

Although specific features of this invention are shown in some drawings and not others, this is for convenience only as each feature may be combined with any or all of the other features in accordance with the invention.

DISCLOSURE OF THE PREFERRED EMBODIMENT

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
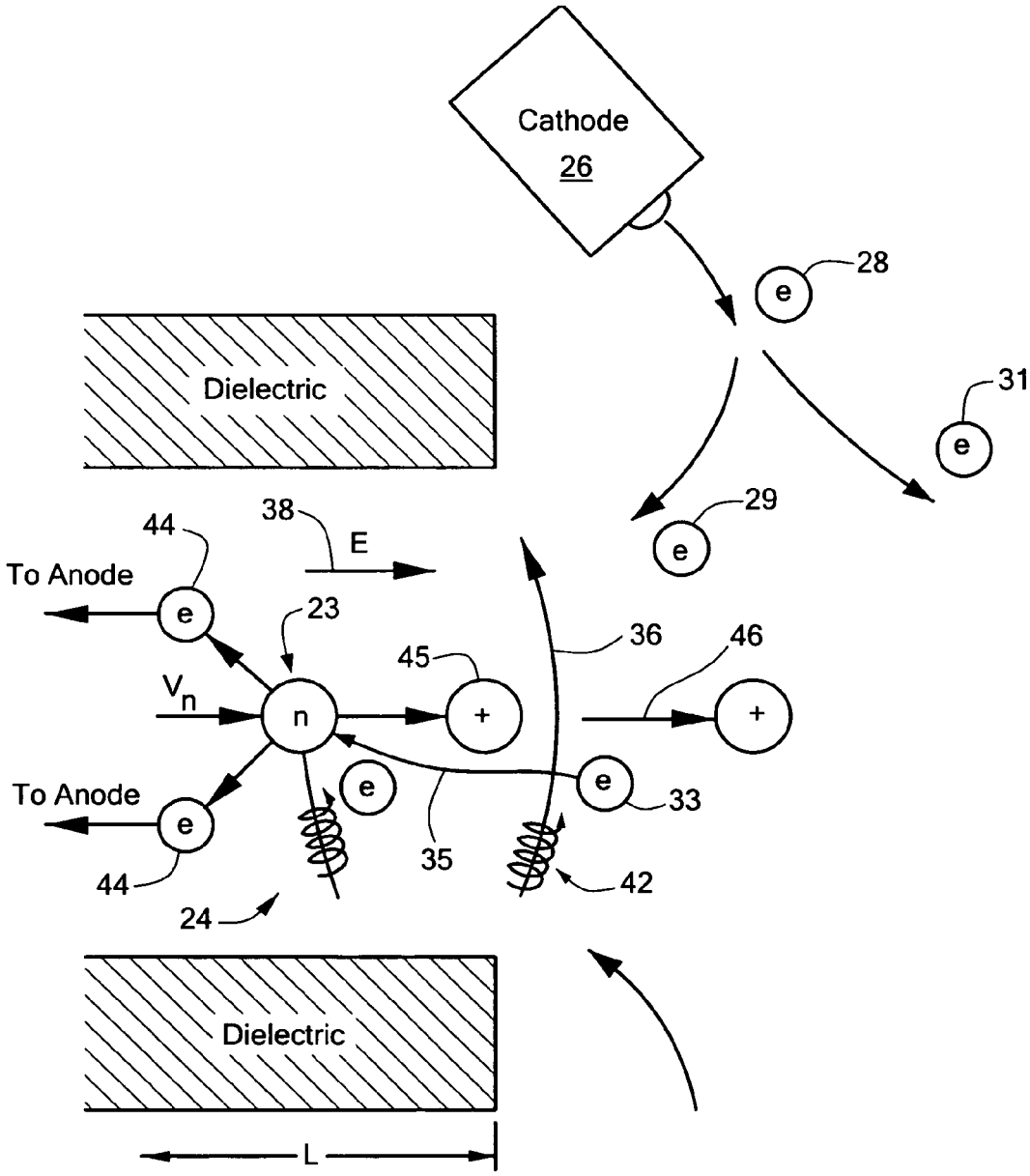
FIG. 2 PRIOR ART
FIG. 2 is an enlarged view of a portion of the prior art thruster shown in FIG. 1 illustrating the ionization of the propellant by electron impact and the interaction of the transverse magnetic and electric field that accelerates the propellant.

A typical conventional Hall effect thruster 20, FIG. 1, includes plasma accelerator 21 with discharge chamber 24, anode 30 and propellant distributor 31 in discharge chamber 24 with transverse magnetic field 36 and axial electric field 38. Propellant 22, e.g., xenon or similar gas, is introduced through propellant distributor 31 into discharge chamber 24. Thruster 20 also typically includes externally located cathode 26 which emits electrons 28, 29, and 31. Anode 30 located within the discharge chamber 24, attracts the electrons 28-31 emitted from cathode 26. Electric circuit 32 creates the axial electric field 38 and magnetic field source 33, e.g., an electromagnetic coil attached to magnetic structure 34 creates transverse magnetic field 36. Transverse magnetic field 36 provides an impedance to the flow of electrons 28-31 toward anode 30 which forces the electrons to travel in a helical fashion about the magnetic field lines associated with magnetic field 36, as shown at 42, FIG. 2.

When the electrons trapped by magnetic field 36 collide with propellant atoms, e.g., atom 23, they create positively charged ions. The positively charged ions are rapidly expelled from discharge chamber 24 due to axial electric field 38, indicated at 46, to generate thrust. For example, when electron 33 on magnetic field line 36 collides with propellant or gas atom 23, indicated at 35, the collision strips one of the electrons, e.g., electron 44 from propellant atom 23, to create positively charged ion 45 which is expelled from discharge chamber 24 by axial electric field 38 to generate thrust.

Figure 3:
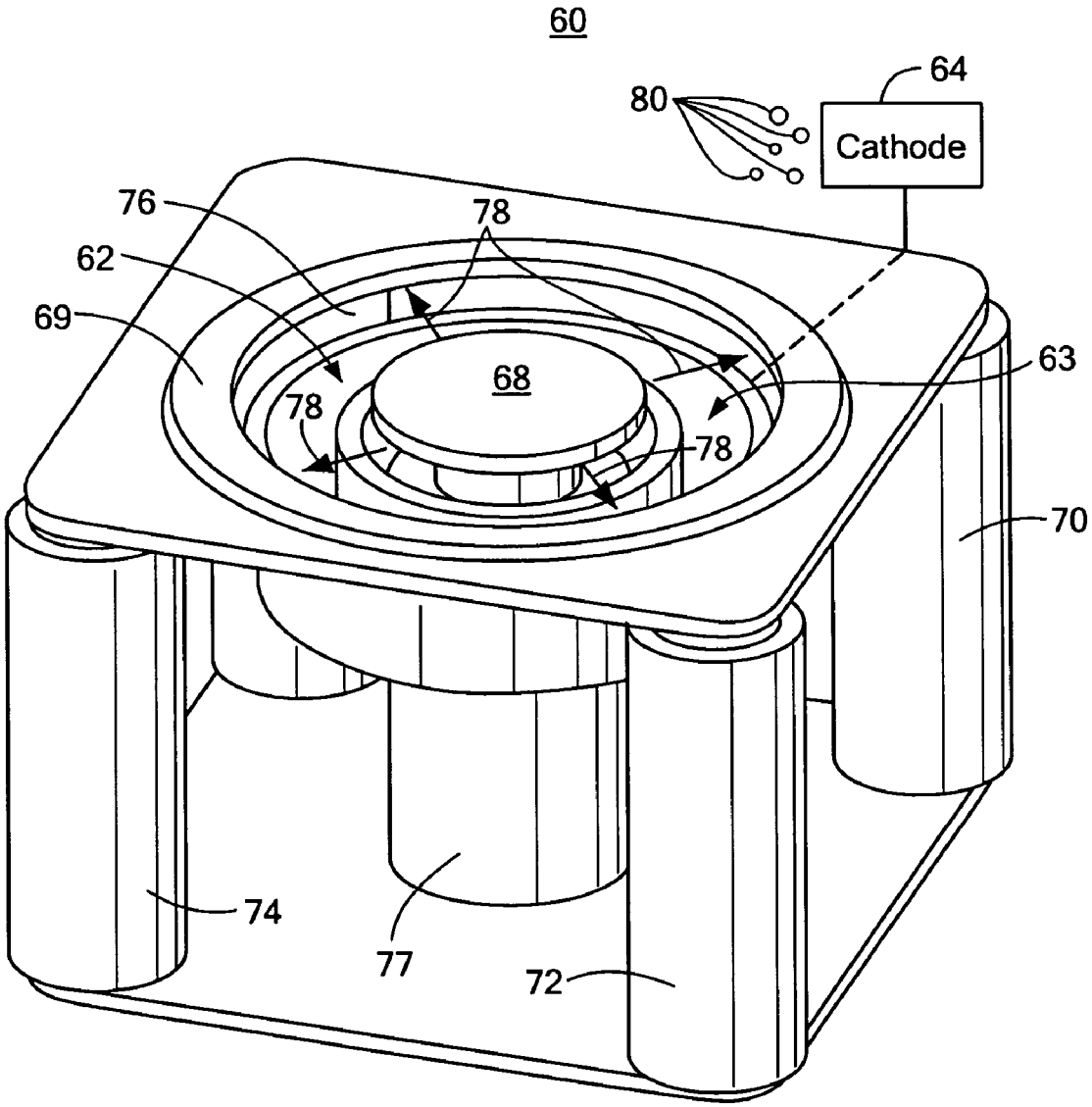
FIG. 3 PRIOR ART
FIG. 3 is a three-dimensional view of a typical conventional Hall thruster.

Conventional Hall thruster 60, FIG. 3, includes a plasma accelerator 62 with anode/discharge chamber 63. Cathode 64 emits electrons 80 that are attracted to anode/discharge chamber 63. Thruster 60 also includes magnetic circuit structure 66 including inner pole 68 and outer pole 69. Outer magnetic field sources 70, 72, 74 and 76, and inner magnetic field source 77, e.g., electromagnetic coils or permanent magnets, create transverse magnetic field 78 between inner pole 68 and outer pole 69 that creates an impedance to the flow of electrons 80 emitted from cathode 64 towards anode/discharge chamber 63, similar to that described above.

When a plurality of conventional Hall thrusters are arranged in close proximity to each other, each plasma accelerator requires its own magnetic circuit structure having an inner pole and an outer pole, a plurality of outer magnetic field sources for the outer pole, and a magnetic field source for the inner pole. For example, one plasma accelerator would require magnetic circuit structure 66*a*, FIG. 4, with inner pole 68*a* and outer pole 69*a*, outer magnetic field source locations 70*a*, 72*a*, 74*a* and 76*a*, and inner magnetic field source location 77*a*. Similarly, the remaining plasma accelerators would each require a magnetic circuit structure, e.g., magnetic circuit structure 66*b* includes inner pole 68*b* and outer pole 69*b*, outer magnetic field sources 70*b*, 72*b*, 74*b* and 76*b* and inner magnetic field source 77*b*; and magnetic circuit structure 66*c* includes inner pole 68*c* and outer pole 69*c*, outer magnetic field sources 70*c*, 72*c*, 74*c* and 76*c*, and inner magnetic field source 77*c*, and magnetic circuit structure 66*d* includes inner pole 68*d* and outer pole 69*d*, outer magnetic field sources 70*d*, 72*d*, 74*d* and 76*d*, and inner magnetic field source 77*d*. Such a design suffers from excessive weight, volume and power requirements of a spacecraft or satellite that utilizes a plurality of Hall thrusters arranged in close proximity.

Figure 5:
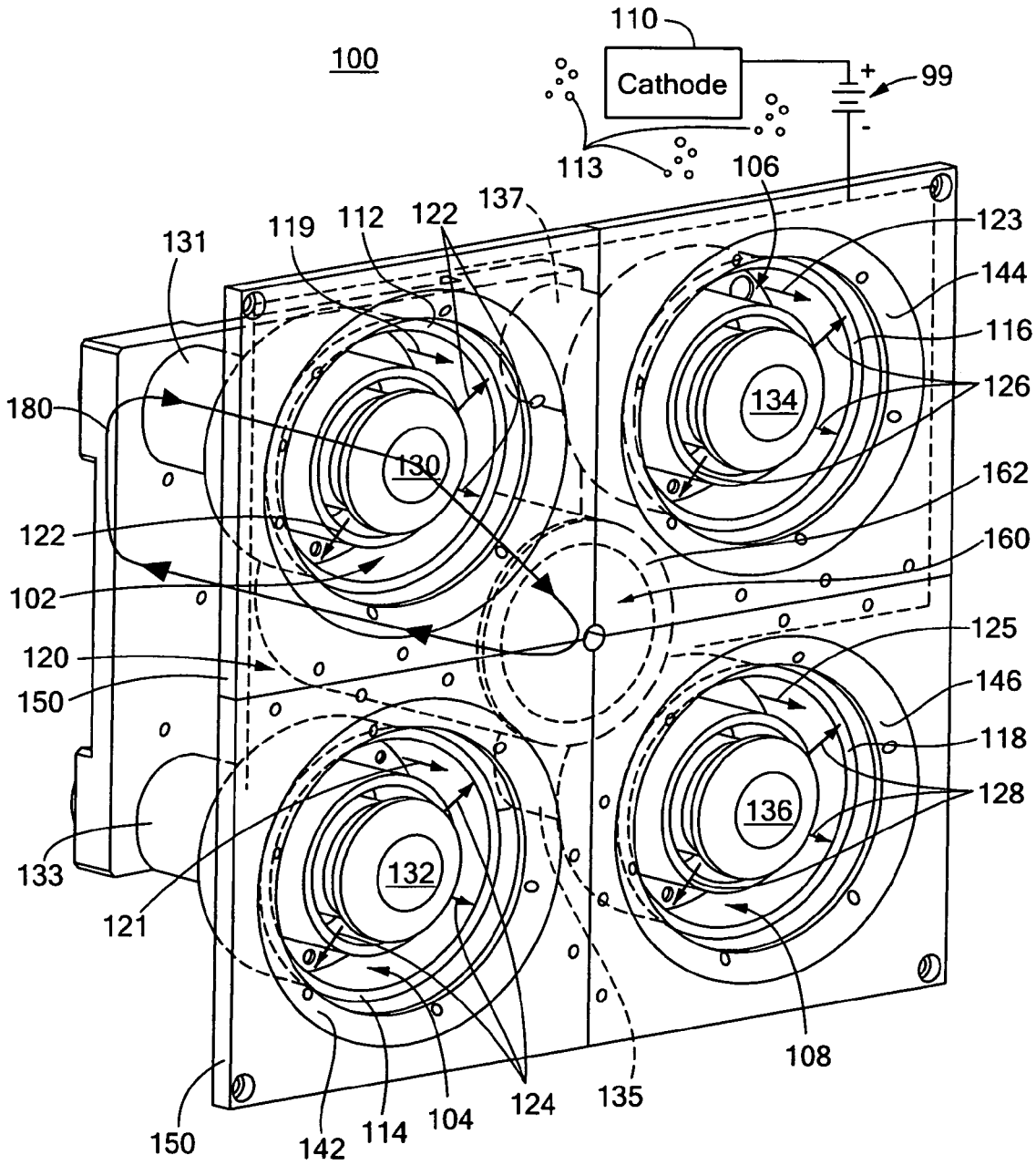
FIG. 5 is a three-dimensional view showing one embodiment of a Hall thruster with a shared magnetic structure of this invention.

In contrast, Hall thruster 100, FIG. 5, with a shared magnetic circuit structure 120 according to this invention, preferably includes a shared magnetic path, e.g., a magnetic core, that establishes a transverse magnetic field between the inner pole and the outer pole of a plurality of plasma accelerators, e.g., plasma accelerators 102, 104, 106 and 108. The shared magnetic path or core reduces the weight, volume, complexity and power requirements of Hall thruster 100, as discussed below.

Hall thruster 100 typically includes plasma accelerators 102, 104, 106 and 108 that provide plasma discharge. Plasma accelerators 102, 104, 106 and 108 each include an anode and a discharge zone, e.g., anode/discharge chambers 112, 114, 116, and 118, respectively. Electric circuit 99 includes one or more cathodes, e.g., cathode 110 connected to plurality of plasma accelerators 102-108 that emit electrons 113 that are attracted to anode/discharge chambers 112-118. Shared magnetic circuit structure 120 establishes transverse magnetic fields 122, 124, 126 and 128 in plasma accelerators 102, 104, 106, 108, respectively. That creates an impedance to the flow of electrons 113 towards anode/discharge chambers 112-118 and enables ionization of a gas moving through plasma accelerators 102-108. This creates axial electric fields 119, 121, 123, 125 in plasma accelerators 102-108, respectively, for accelerating the ionized gas through one or more of plasma accelerators 102-108 to create thrust, as described above with reference to FIGS. 1 and 2.

Shared magnetic circuit structure 120, FIG. 5, preferably includes a shared outer pole and an inner pole for each of plasma accelerators 102-108. For example, shared magnetic circuit structure 120 includes outer pole 140 and inner pole 130 for plasma accelerator 102, and outer pole 142 and inner pole 132 for plasma accelerator 104, outer pole 144 and inner pole 134 for plasma accelerator 106, and outer pole 146 and inner pole 136 for plasma accelerator 108. Shared magnetic circuit structure 120 also includes a magnetic material, e.g., front plate 150, that includes outer poles 140-146 and back plate 152 that interconnects inner poles 130-136. Shared magnetic circuit structure 120 also includes outer magnetic field sources 131, 133, 135, and 137, e.g., a permanent magnet, electromagnetic coil, or superconducting electromagnetic coil, associated with inner poles 130-136 of plasma accelerators 102-108, respectively.

Shared magnetic circuit structure 120 also preferably includes shared magnetic path 160, e.g., a magnetic core that is shared by plasma accelerators 102-108. Shared circuit structure 120 with shared magnetic path 160 and magnetic field sources 131-137 establish transverse magnetic fields 122-126 in each of plasma accelerators 102-108. Shared magnetic path 160 is typically configured as a magnetic core made of a magnetic material. Shared magnetic path 160 may also include magnetic field source 162, e.g., an electromagnetic coil, superconducting electromagnetic coil. In other designs, shared magnetic path 160 may be configured as a permanent magnet, such as an Alnico type magnet that includes aluminum, nickel and cobalt, a hard ferrite magnet, a sintered neodymium-iron-boron (NdFeB) magnet, a samarium cobalt (SmCo) magnet, or any similar type magnet. Shared magnetic path 160 may also include any combination of an electromagnetic coil and a permanent magnet. Similarly, magnetic field sources 131-137 may be configured as a permanent magnet as discussed above, an electromagnetic coil, or any combination thereof.

Shared magnetic circuit structure 120 carries magnetic flux between inner poles 130-136 and outer poles 140-146 of plasma accelerators 102-108, respectively, through the magnetic material (e.g., front plate 150 and back plate 152) and shared magnetic path 160. For example, shared magnetic circuit structure 120 carries magnetic flux between inner pole 130 and outer pole 140 of plasma accelerator 102 through front plate 150, through shared magnetic path 160, through back plate 152, to inner pole 130, as shown by loop 180. In other examples, shared magnetic circuit structure 120 may carry magnetic flux in a direction opposite to loop 180.

Figure 4:
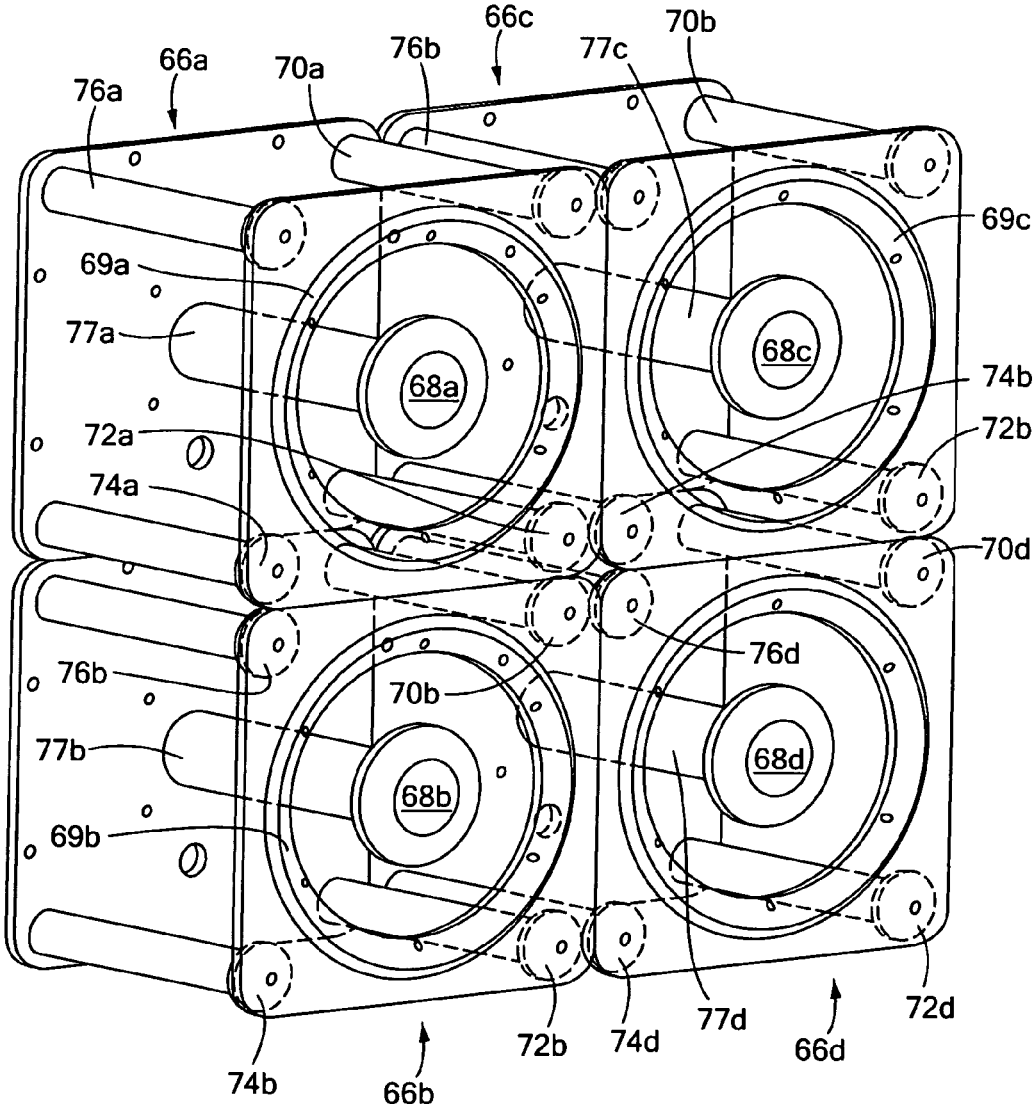
FIG. 4 PRIOR ART
FIG. 4 is a three-dimensional view showing the primary components of four conventional Hall thrusters located in close proximity to each other.

The result is that Hall thruster 100 with shared magnetic circuit structure 120 and shared magnetic path 160 significantly reduce the number of magnetic field sources required to create the transverse magnetic fields 122-126 in plasma accelerators 102-108, respectively. For example, as shown in FIG. 4, a typical conventional Hall thruster design that includes four close proximity Hall thrusters with four plasma accelerators and the associated magnetic circuit structures 66*a*-66*d* requires at least sixteen (16) outer magnetic field sources, e.g., magnetic field sources 70*a*-76*d*, 70*b*-76*d*, 70*c*-76*d*, and 70*d*-76*d* associated with outer poles 69*a*, 69*b*, 69*c*, and 69*d*, respectively, and four (4) inner magnetic field sources 77*a*, 77*b*, 77*c*, and 77*d* associated with inner poles 68*a*, 68*b*, 68*c* and 68*d*, e.g., to create the transverse magnetic fields between inner poles 68*a*-68*d* and outer poles 69*a*-69*d*, respectively.

In contrast, Hall thruster 100, FIG. 5, of this invention, with shared magnetic circuit structure 120 and shared magnetic path 160 requires only four outer magnetic field sources for inner poles 130-136, e.g., magnetic field sources 131, 133, 135, and 137, and one magnetic field source for shared magnetic path 160, e.g., shared magnetic path 160 includes a magnetic field source, e.g., a permanent magnet or electromagnet coil, to establish transverse magnetic fields 122-126 in each of plasma accelerators 102-108. The result is a significant reduction in weight, volume, complexity, power, thermal requirements, and cost of Hall thruster 100. Although as described above with reference to FIG. 5, Hall thruster 100 includes four plasma accelerators and the associate components therewith, this is not a necessary limitation of this invention, as Hall thruster 100 may have any number of plasma accelerators.

Figure 6:
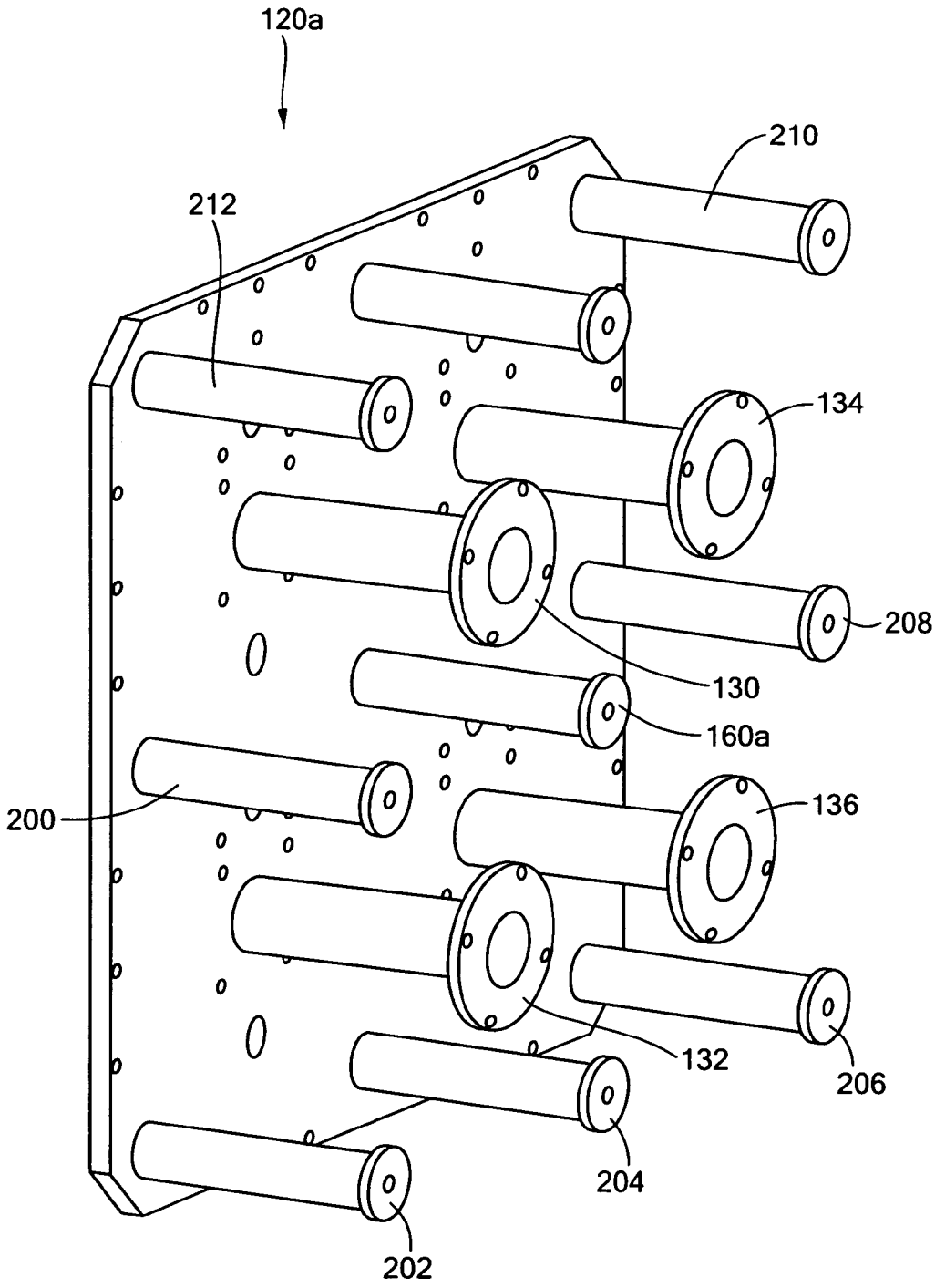
FIG. 6 is a three-dimensional view showing another example of the shared magnetic circuit structure of the Hall thruster of this invention.

In other designs, Hall thruster 100 may include a shared magnetic circuit structure 120*a*, FIG. 6, that includes a plurality of shared magnetic paths 160*a*, 200, 202, 204, 206, 208, 210 and 212 magnetic shared paths 160*a* and 200-212 may be a core made of a magnetic material, or a magnetic field sources such as, e.g., permanent magnets or electromagnetic coils as described above. In this example, shared magnetic paths or cores 160*a* and 200-212 reduce the number of outer magnetic field sources needed to establish the transverse magnetic fields between the inner poles and shared outer poles, e.g., from a total of sixteen as shown in FIG. 4, to a total of nine, as shown in FIG. 6. The result is a significant reduction in weight and volume of shared magnetic circuit structure 120.

Figure 7:
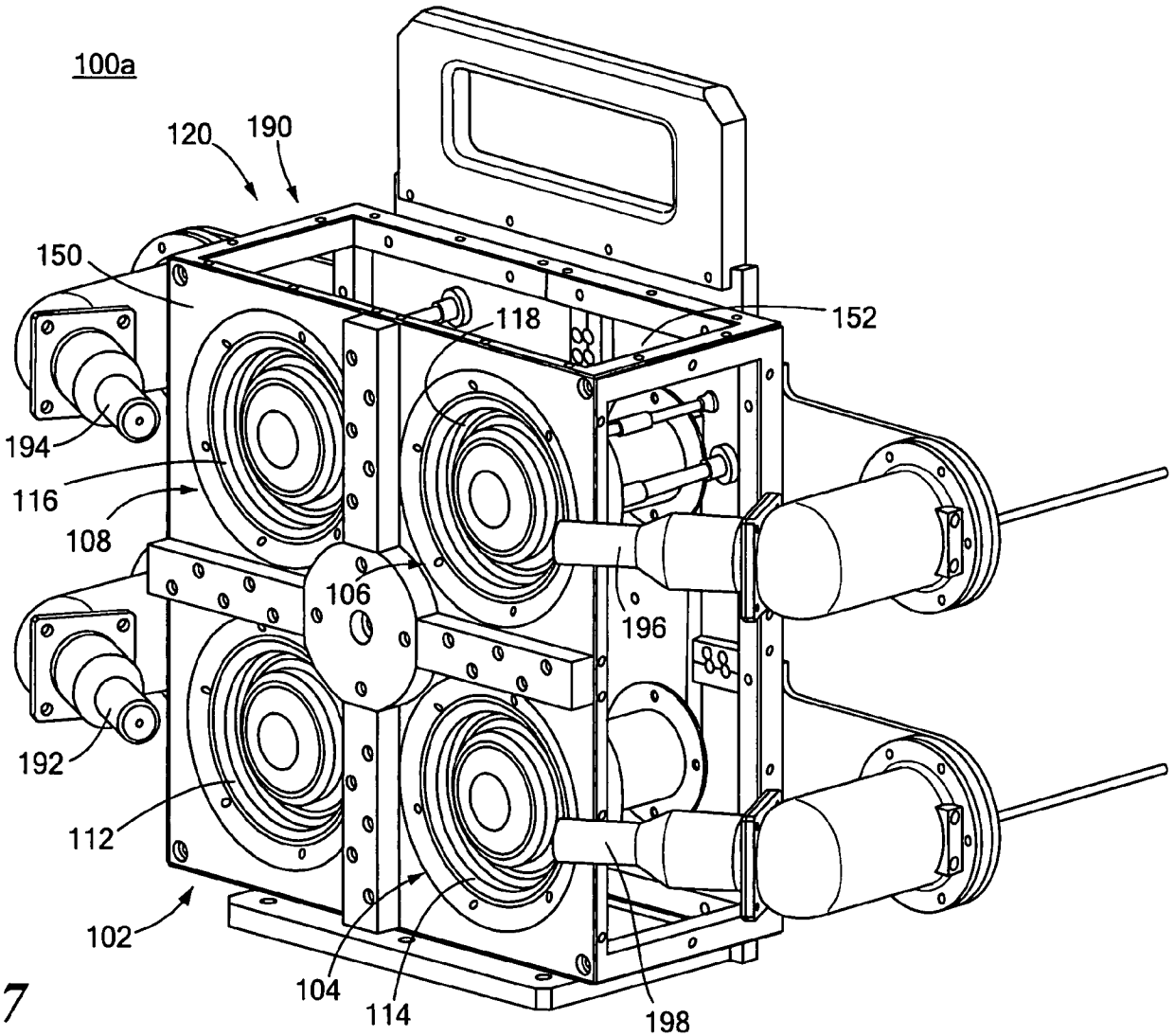
FIG. 7 is a schematic three-dimensional view showing an example of a plurality of cathodes connected to the Hall thruster with shared magnetic structure shown in FIG. 5.

Hall thruster 100*a*, FIG. 7, where like parts have been given like numbers, includes shared magnetic circuit structure 120 described above with front plate 150, back plate 152, and assembly 190 made of a magnetic material that interconnects front plate 150 and back plate 152. In this design, Hall thruster 100*a* includes four cathodes 192, 194, 196 and 198 that emit electrons that are attracted to anode/discharge chambers 112-118 as described above. Any of plasma accelerators 102-108 of Hall thruster 100*a* may be selectively enabled or disabled for steering and providing attitude control for Hall thruster 100*a* by selectively enabling gas to any of plasma accelerators 102-108, (discussed below) or selectively powering plasma accelerators 102-108.

In other embodiments of this invention, the Hall thruster with a shared magnetic circuit structure may include one or more inner plasma accelerators and one or more outer plasma accelerators concentrically arranged. For example, Hall thruster 100*b*, FIG. 8, includes inner plasma accelerator 220 and outer plasma accelerator 223. Shared magnetic circuit structure 120*a* includes shared magnetic path or core 209 that includes outer pole 208 for inner plasma accelerator 220 and inner pole 210 for outer plasma accelerator 222. Inner plasma accelerator 220 includes inner pole 212 and outer plasma accelerator 222 includes outer pole 213. Similar as described above, shared magnetic circuit structure 120*a* establishes a transverse magnetic field between inner pole 212 and outer pole 208 of plasma accelerator 220 and between inner pole 210 and outer pole 213 of plasma accelerator 223. Although as shown in FIG. 8, Hall thruster 100*b* includes two plasma accelerators concentrically arranged, this is not a necessary limitation of this invention as Hall thruster 100*b* may include any number of plasma accelerators concentrically arranged.

Figure 8:
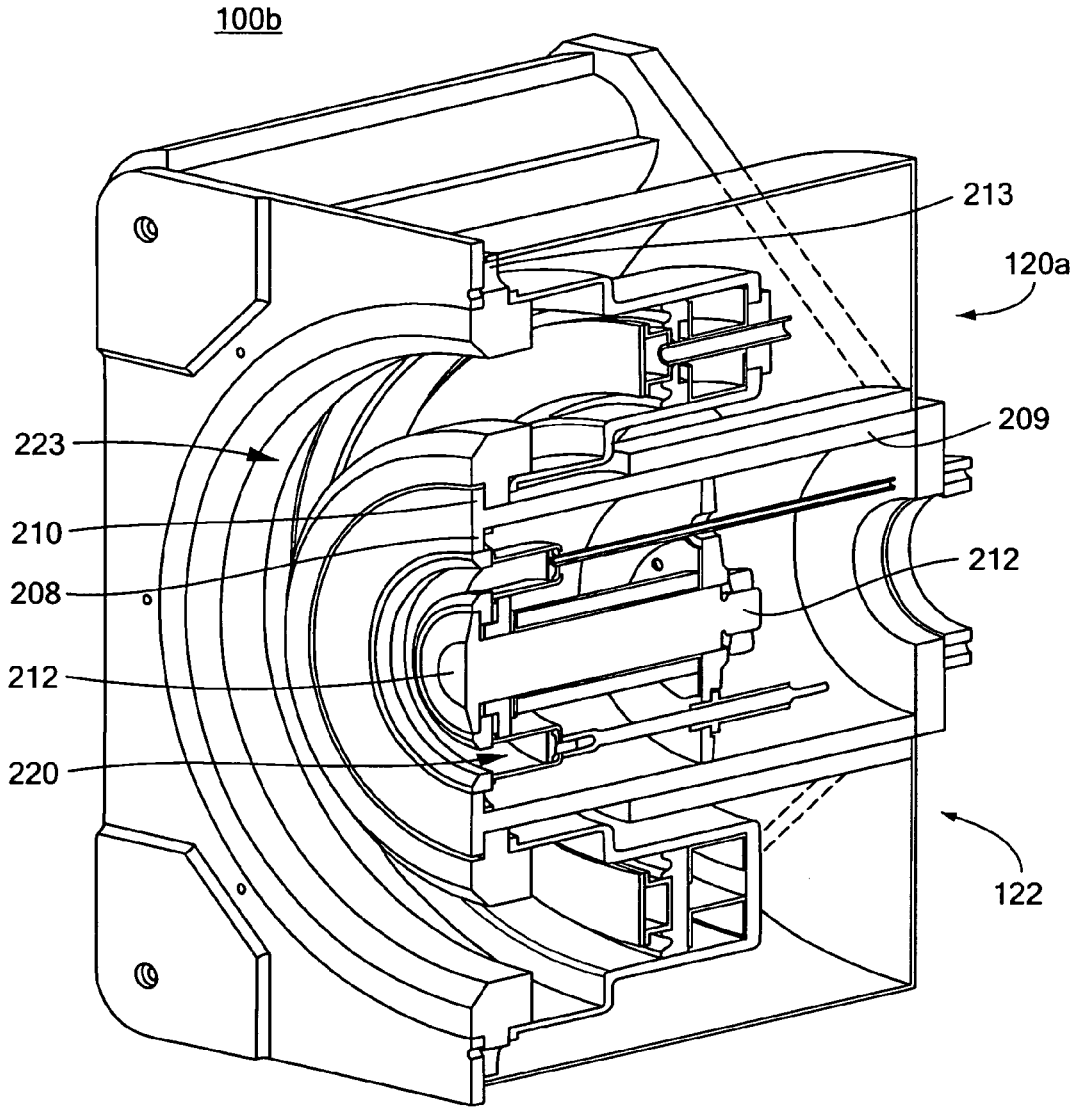
FIG. 8 is a three-dimensional front-side view of another embodiment of a Hall thruster with a shared magnetic structure of this invention in which the plasma accelerators are concentrically arranged.
Figure 9:
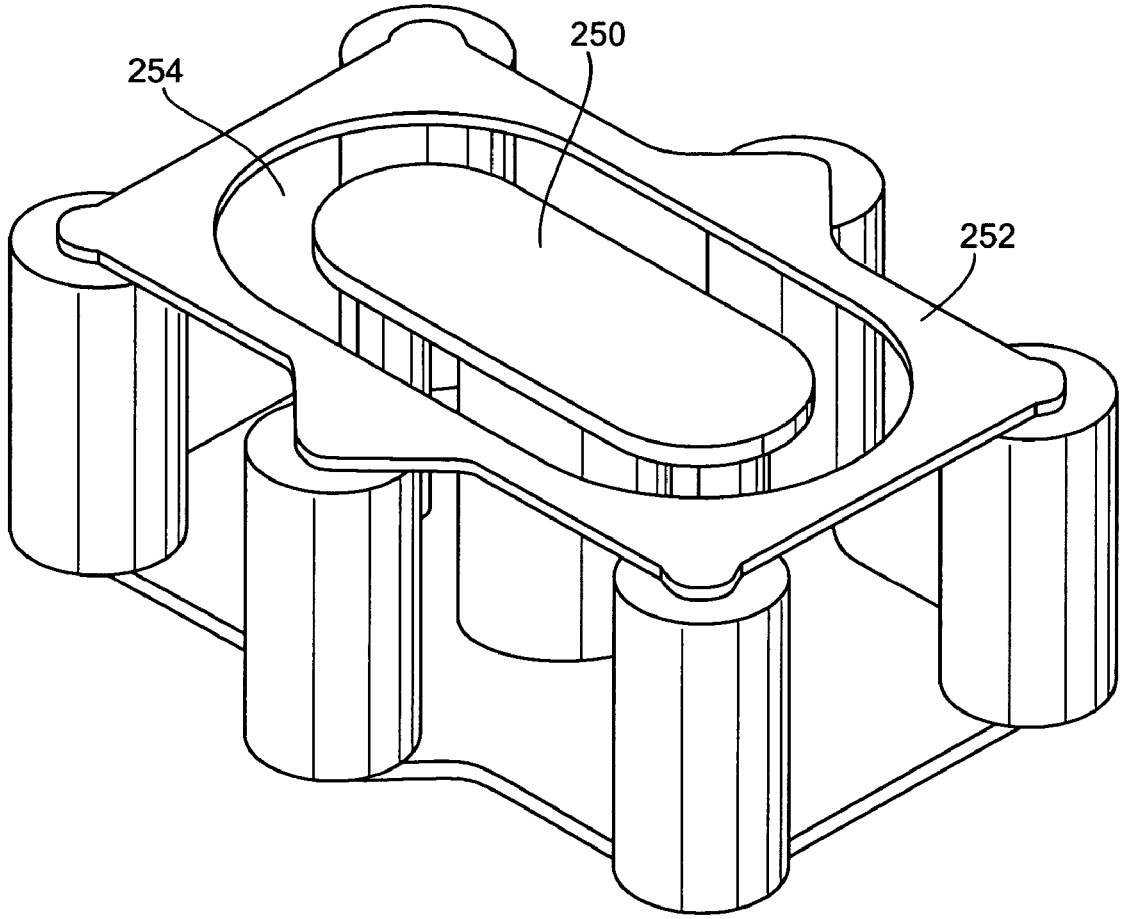
FIG. 9 is a three-dimensional view showing an example a racetrack shaped inner pole and outer pole that define a racetrack shaped plasma gap that may be employed in one or more of the plasma accelerators of this invention.

Any of plasma accelerators 102-108 of Hall thrusters 100, 100*a* and 100*b*, FIGS. 5, 7, and 8 discussed above may include a racetrack shaped inner pole and an outer pole that define a racetrack shaped plasma gap. FIG. 9 shows one example of racetrack shaped inner pole 250 and outer pole 252 that define racetrack shaped plasma gap 254. The racetrack shaped plasma accelerator offers scaling advantages.

Figure 10:
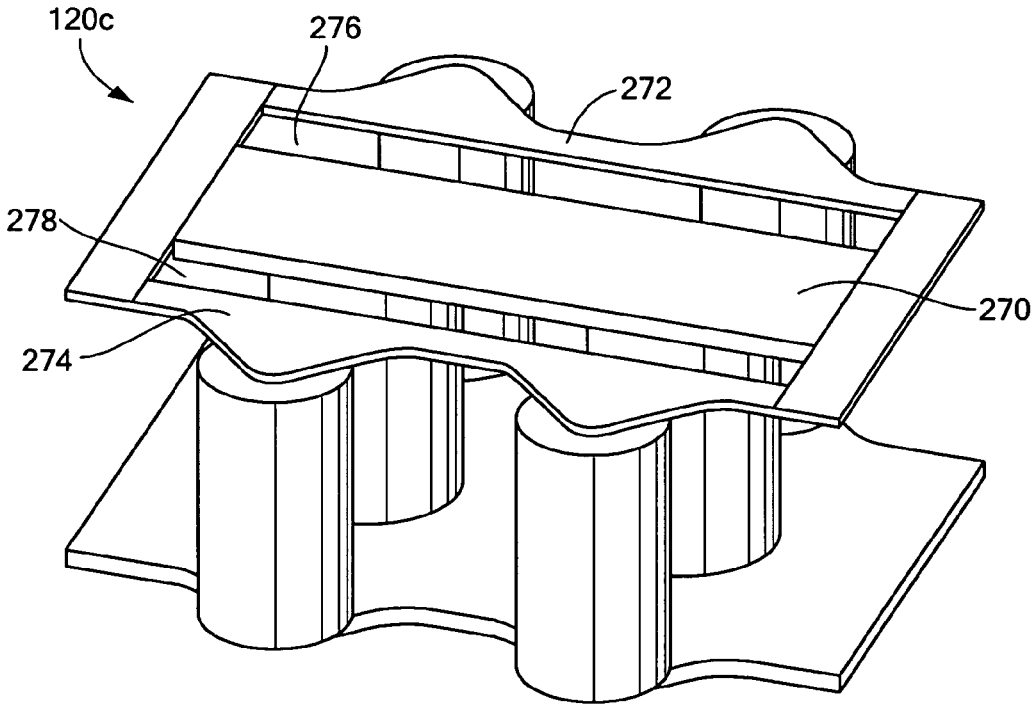
FIG. 10 is a three-dimensional view showing an example of the shared magnetic structure of the Hall thruster of this invention that defines a plurality of slit shaped plasma gaps.

The shared magnetic circuit structure may include an outer pole and inner poles that define slit shaped plasma gaps. For example, shared magnetic circuit structure 120*c*, FIG. 10 includes inner pole 270 and outer poles 272 and 274 that define slit shaped plasma gaps 276 and 278.

Figure 11:
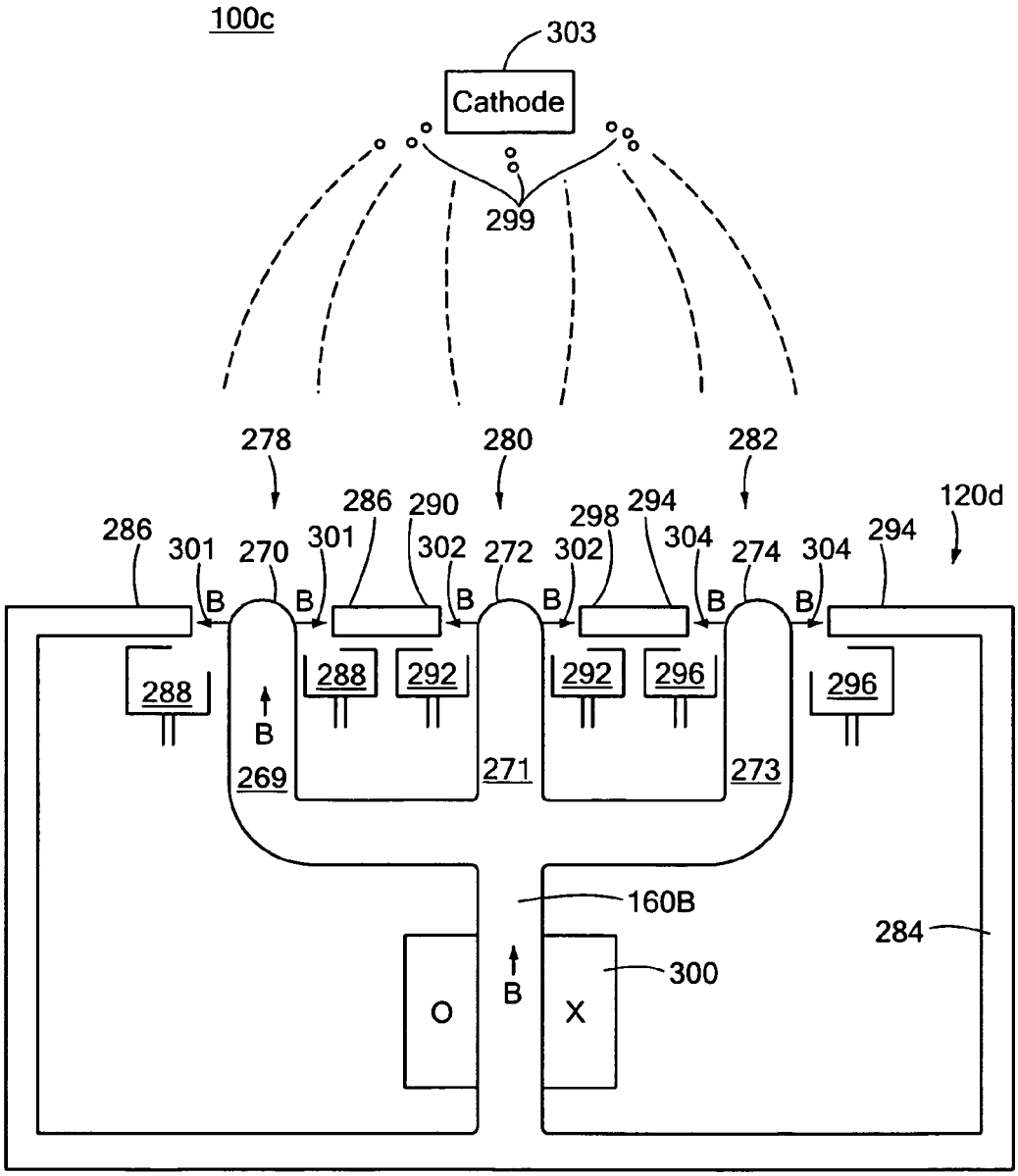
FIG. 11 is a schematic side view of another embodiment of a Hall thruster with shared magnetic structure in accordance with this invention.

Hall thruster 100*c*, FIG. 11, of this invention with shared magnetic circuit structure 120*d* includes shared magnetic path 160*b*, e.g., a magnetic core made of a magnetic material as described above, that includes branches 269, 271 and 273 that provide inner poles 270, 272, and 274 for plasma accelerators 278, 280, and 282, respectively. Shared magnetic circuit structure 120*d* includes magnetic structure 284 that provides outer pole 286 for plasma accelerator 278, outer pole 290 for plasma accelerator 280, and outer pole 294 for plasma accelerator 282. Similar as described above, plasma accelerator 278 includes anode/discharge chamber 288, plasma accelerator 280 includes anode/discharge chamber 292 and plasma accelerator 282 includes anode/discharge chamber 296. In this example, shared magnetic path 160*b* includes magnetic field source 300, e.g., an electromagnetic coil 300 that creates transverse magnetic field 301 between inner pole 270 and outer pole 286, transverse magnetic field 302 between inner pole 272 and outer pole 290, and transverse magnetic field 304 between inner pole 274 and outer pole 294. Transverse magnetic fields 301-304 present an impedance to electrons 299 emitted from cathode 303 which is used to create thrust, as described above. In this design, branched shared magnetic path 160*b* includes poles 270, 272, and 274 that are arranged in a parallel configuration. Shared magnetic path 160*b* may also be configured as a permanent magnet or a combination of an electromagnetic coil and a permanent magnet.

Figure 12:
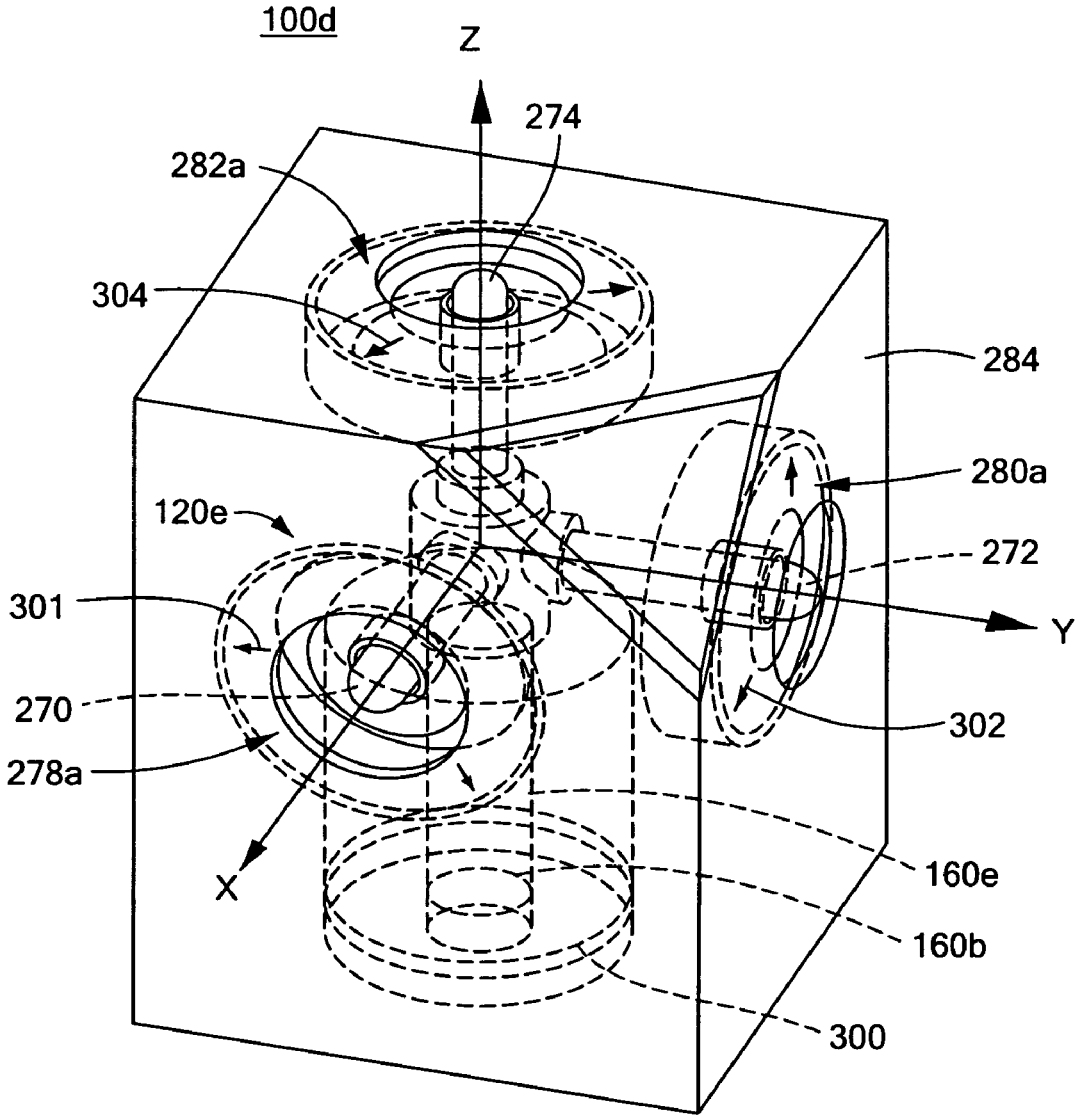
FIG. 12 is a three-dimensional view of yet another embodiment of a Hall thruster with shared magnetic structure in accordance with this invention.

In other embodiments of this invention, Hall thruster 100*d*, FIG. 12, where like parts have been given like numbers, includes shared magnetic path 160*c* with inner poles 270, 272 and 274 that are arranged at an angle, e.g., orthogonal, to each other. Plasma accelerators 278*a*, 280*a*, and 282*a* are similarly arranged orthogonal to each other. In this example, magnetic structure 284 is configured as a housing about plasma accelerators 278*a*-282*a*. Similar as described above, magnetic circuit structure 120*e* and shared magnetic path 160*c* with electromagnetic coil 300 establishes transverse magnetic fields 301, 302, and 304 for plasma accelerators 278*a*, 280*a* and 282*a*, respectively. In operation various plasma accelerators 278*a*-282*a* may be selectively enabled for steering and attitude control of thruster 100*d*.

Figure 13:
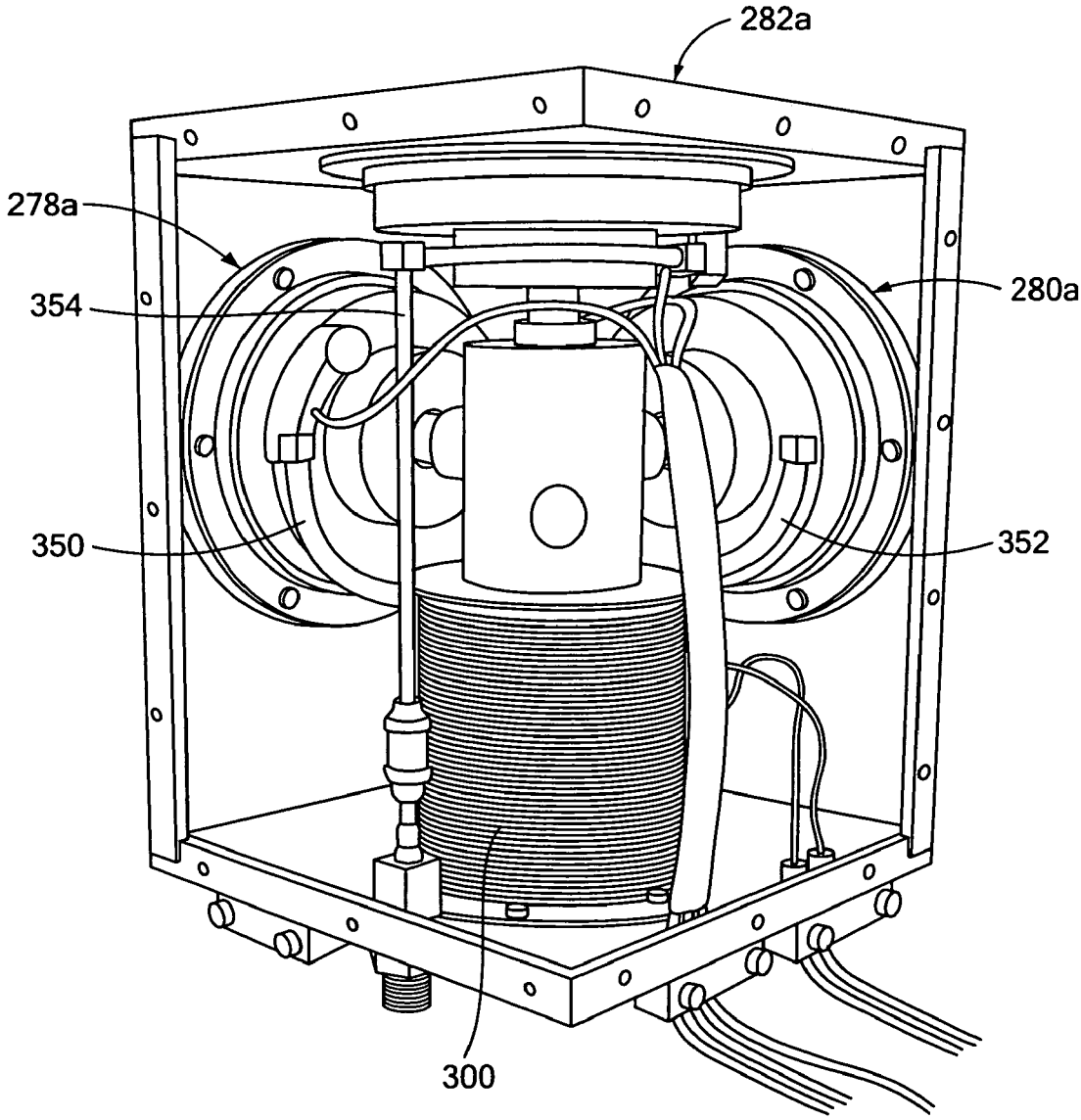
FIG. 13 is a three-dimensional view showing in further detail the components of the Hall thruster with shared magnetic structure shown in FIG. 12.
Figure 14:
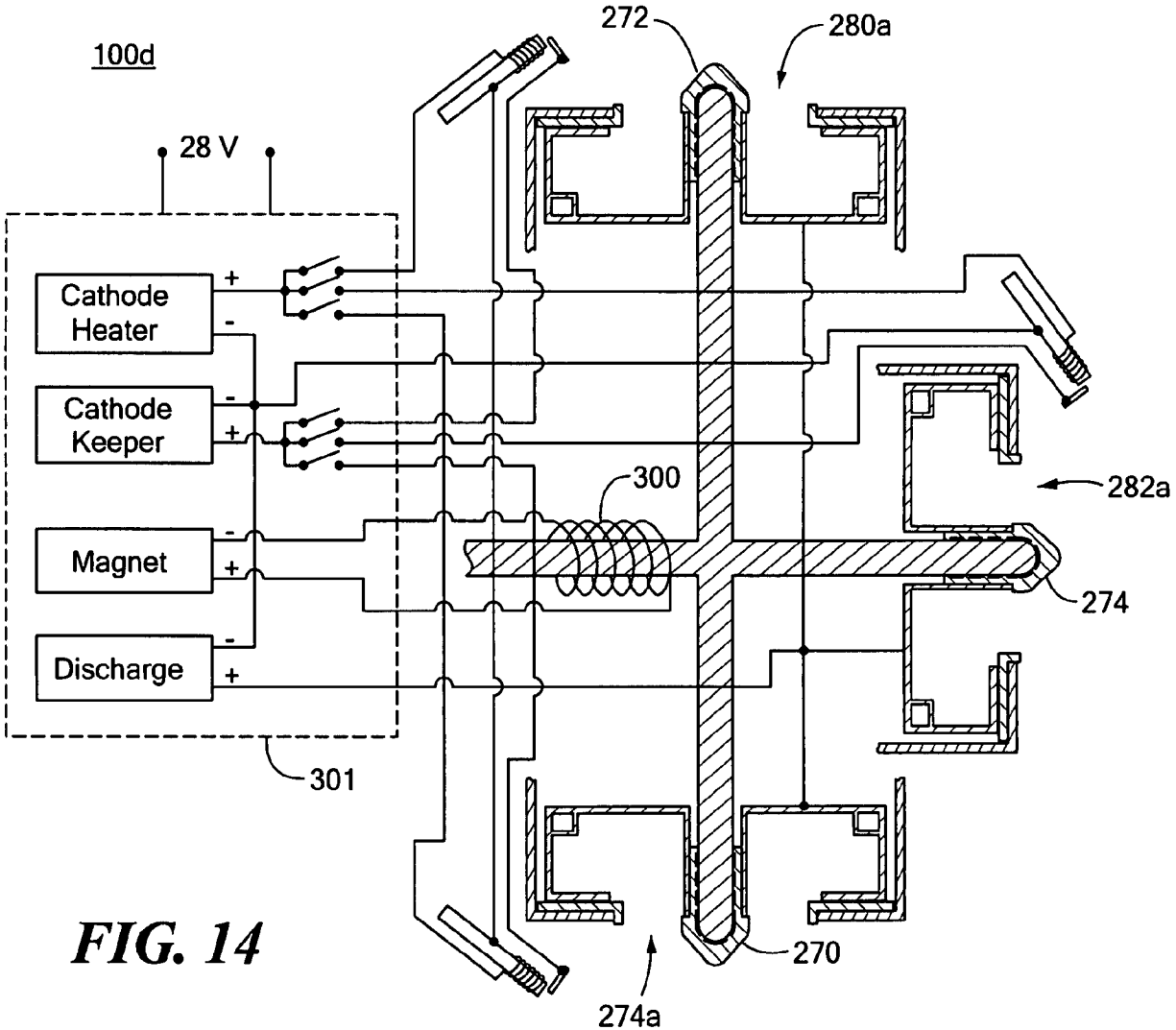
FIG. 14 is a schematic circuit diagram of the Hall thruster with shared magnetic circuit structure shown in FIG. 12 employing a shared power processing unit.
Figure 15:
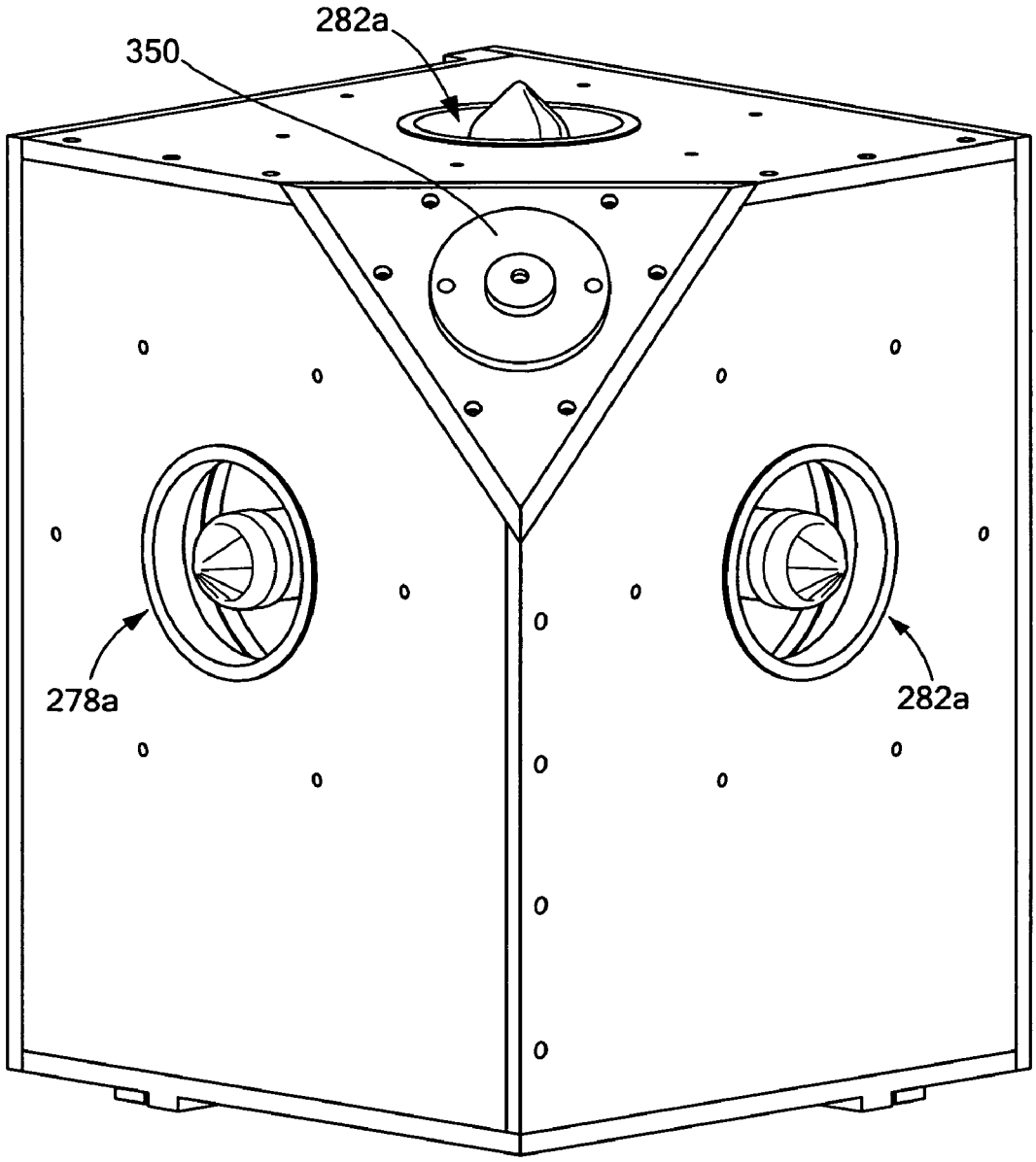
FIG. 15 is a three-dimensional view showing a Hall thruster with the shared magnetic circuit structure shown in FIG. 12 employing a single cathode.

An example of electromagnetic coil 300 is shown in FIG. 13, where like parts have been given like numbers. Hall thruster 100*d* may also include a shared power processing unit 301, FIG. 14, where like parts have been given like numbers, that provides power to electromagnetic coil 300 and plasma accelerators 278*a*-282*a*, as well as the shared magnetic circuit structure and magnetic field sources associated therewith, as described above. Shared power processing unit 301 eliminates the need for a separate power processing unit for each of the plasma accelerators and therefore saves weight and volume and reduces cost. Gas lines 350, 352 and 354, FIG. 13 provide gas to the anode/discharge chambers described above. In operation, the gas provided to any of plasma accelerators 278*a*-282*a* can be selectively controlled for throttling and steering Hall thruster 100*d*. FIG. 15 shows an example of Hall thruster 100*d* with plasma accelerators 178*a*-282*a* that includes and shared cathode 350.

Figure 16:
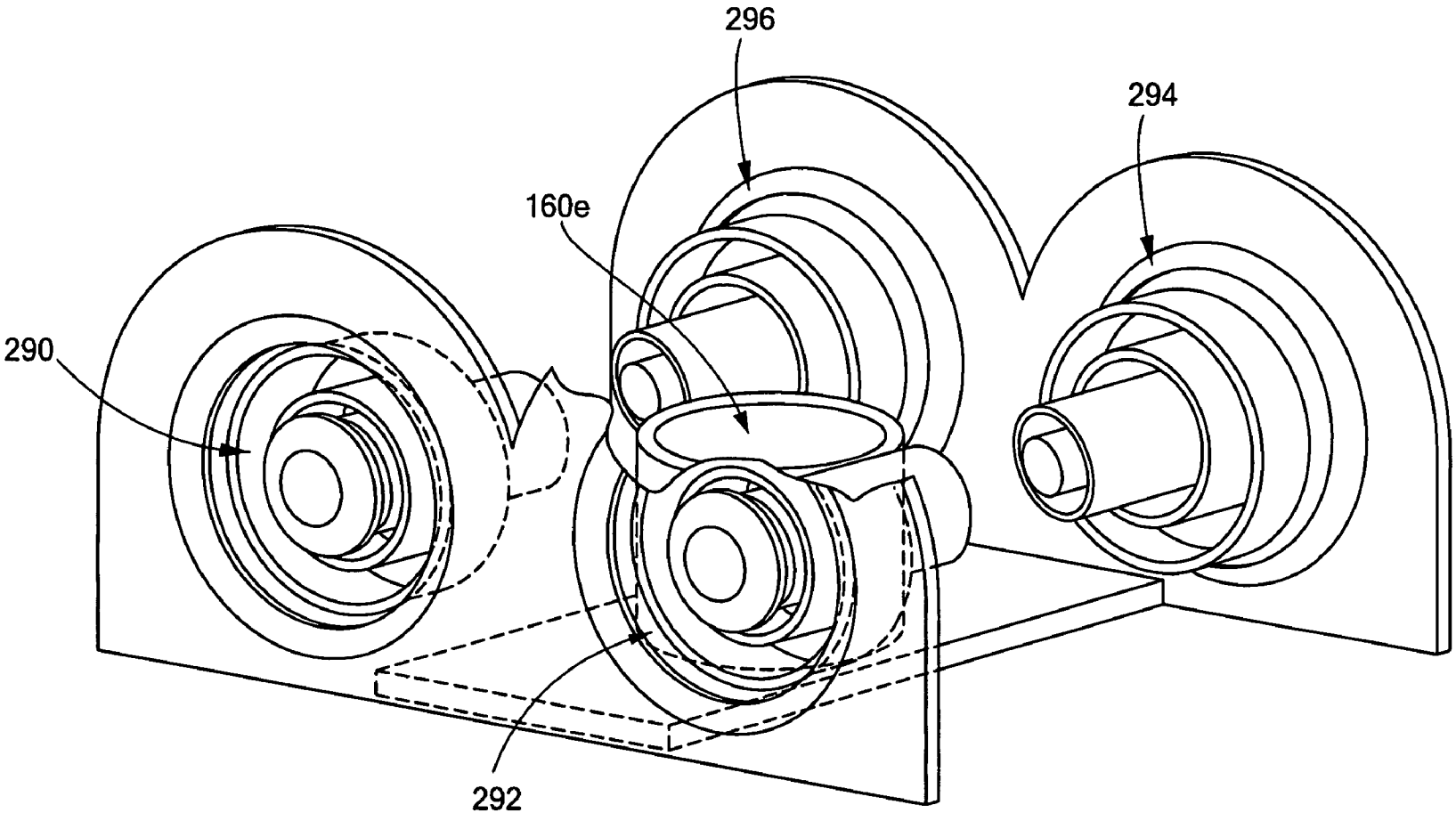
FIG. 16 is a three-dimensional view of yet another embodiment of a Hall thruster with shared magnetic structure in accordance with this invention.

Hall thruster 100*e*, FIG. 16 shows an example in which branched shared magnetic path 160*c* provides for oppositely oriented plasma accelerators 290, 292, 294 and 296.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A Hall thruster with a shared magnetic structure comprising:

a plurality of plasma accelerators each including an anode and a discharge zone for providing plasma discharge;

an electrical circuit having one or more cathodes connected to said plurality of plasma accelerators for emitting electrons that are attracted to said anode in each of said plasma accelerators; and a shared magnetic circuit structure for establishing a transverse magnetic field in each of said plurality of plasma accelerators that creates an impedance to the flow of electrons toward said anode in each of said plurality of plasma accelerators and enables ionization of a gas moving through one or more of said plurality of plasma accelerators and which creates an axial electric field in said plurality of plasma accelerators for accelerating ionized gas through said one or more of said plurality of plasma accelerators to create thrust.

2. The Hall thruster of claim 1 in which said shared magnetic circuit structure includes at least one magnetic field source for creating said transverse magnetic field in each of said plurality of plasma accelerators.

3. The Hall thruster of claim 2 in which said at least one magnetic field source includes a magnetic field source chosen from the group consisting of: an electromagnetic coil and a permanent magnet.

4. The Hall thruster of claim 3 in which said shared magnetic circuit structure includes a selected combination of said at least one magnetic field source.

5. The Hall thruster of claim 2 in which said shared magnetic circuit structure includes an outer pole and an inner pole for each of said plurality of plasma accelerators.

6. The Hall thruster of claim 5 in which said shared magnetic circuit structure includes a magnetic material interconnecting said outer pole and said inner pole.

7. The Hall thruster of claim 6 in which said shared magnetic circuit structure includes at least one shared magnetic path for establishing said transverse magnetic field in each of said plurality of plasma accelerators.

8. The Hall thruster of claim 7 in which said shared magnetic circuit structure carries magnetic flux between said inner pole and said outer pole and through said magnetic material and said shared magnetic path.

9. The Hall thruster of claim 7 in which said shared magnetic path includes at least one magnetic field source chosen from the group consisting of: an electromagnetic coil and a permanent magnet.

10. The Hall thruster of claim 9 in which said shared magnetic path includes a selected combination of said at least one magnetic field source.

11. The Hall thruster of claim 7 further including a plurality of shared magnetic paths for establishing said transverse magnetic field in each of said plurality of plasma accelerators.

12. The Hall thruster of claim 11 in which said plurality of shared magnetic paths each include one or more magnetic field sources chosen from the group consisting of an electromagnetic coil and a permanent magnet.

13. The Hall thruster of claim 11 in which said plurality of magnetic paths include a selected combination of said one or more magnetic field sources.

14. The Hall thruster of claim 1 further including a plurality of cathodes.

15. The Hall thruster of claim 1 in which said plurality of plasma accelerators are selectively enabled for steering and attitude control of said Hall thruster.

16. The Hall thruster of claim 9 in which said shared magnetic path reduces the number of said one or more magnetic sources required to achieve a predetermined said transverse magnetic field in each of said plurality of plasma accelerators.

17. The Hall thruster of claim 16 in which the reduced number of said one or more magnetic field sources decreases the weight and volume of said Hall thruster.

18. The Hall thruster of claim 7 in which said plurality of plasma accelerators includes one or more inner plasma accelerators and one or more outer plasma accelerators arranged concentrically.

19. The Hall thruster of claim 18 in which said shared magnetic path provides an outer pole for said one or more inner plasma accelerators and an inner pole for said one or more outer plasma accelerators that establish said transverse magnetic field in each of the concentrically arranged plasma accelerators.

20. The Hall thruster of claim 7 in which said inner pole is racetrack shaped.

21. The Hall thruster of claim 20 in which said inner pole and said outer pole define a racetrack shaped plasma gap.

22. The Hall thruster of claim 7 in which said inner pole and said outer pole are linearly shaped to define at least one linearly shaped plasma gap.

23. The Hall thruster of claim 7 in which said shared magnetic path includes a plurality of branches that provide said inner pole for each of said plurality of plasma accelerators.

24. The Hall thruster of claim 23 in which said plurality of branches are arranged relative to each other in a configuration chosen from the group consisting of: an orthogonal configuration, an angle configuration, a parallel configuration, and an opposite configuration.

25. The Hall thruster of claim 24 in which said plurality of plasma accelerators are arranged relative to each other in a configuration chosen from the group consisting of: an orthogonal configuration, an angle configuration, a parallel configuration, and an opposite configuration.

26. The Hall thruster of claim 25 in which said at least one of said plurality of plasma accelerators are selectively enabled for steering and attitude control of said Hall thruster.

27. The Hall thruster of claim 1 further including one or more shared power processing units for providing power to said electrical circuit and said shared magnetic circuit structure.

28. The Hall thruster of claim 1 in which said gas is selectively provided to at least one of said plurality of plasma accelerators to create said thrust.

29. The Hall thruster of claim 28 in which selectively providing said gas to said one or more of said plurality of plasma accelerators is used for throttling, steering and attitude control of said Hall thruster.

* * * * *